United States Patent [19]

Shelton

[11] Patent Number: 4,915,323

[45] Date of Patent: Apr. 10, 1990

[54] YARN FEED APPARATUS

[75] Inventor: William E. A. Shelton, Leicester, England

[73] Assignee: Alan Shelton Limited, Leicester, England

[21] Appl. No.: 255,139

[22] Filed: Oct. 7, 1988

[30] Foreign Application Priority Data

Oct. 10, 1987 [GB] United Kingdom ..... 8723843
Feb. 6, 1988 [GB] United Kingdom ..... 8802712

[51] Int. Cl.[4] ..... B65H 51/00; D04B 15/50

[52] U.S. Cl. ..... 242/47.01; 242/157 R; 66/132 T; 66/146

[58] Field of Search ..... 242/47.01, 47.12, 47.13, 242/147, 45, 149, 154, 157 R; 139/452, 381; 66/132 T, 132 R, 125 A, 125 R, 146; 226/196, 168; 57/352

[56] References Cited

U.S. PATENT DOCUMENTS

| | | | |
|---|---|---|---|
| 1,826,354 | 10/1931 | Lenk | 242/149 |
| 2,209,839 | 7/1940 | Long | 66/146 |
| 2,942,803 | 6/1960 | Baumgardner | 66/146 |
| 2,955,774 | 10/1960 | Letsch | 242/149 |
| 2,979,283 | 4/1961 | Letsch | 242/149 |
| 3,352,510 | 11/1967 | Franzen | 242/149 |
| 3,383,072 | 5/1968 | Horvath | 242/149 |
| 3,834,600 | 9/1974 | Benchemoul | 242/157 R |
| 4,106,274 | 8/1978 | Eaves | 57/352 X |
| 4,352,471 | 10/1982 | Zust | 242/147 R |
| 4,395,872 | 8/1983 | Riedl | 57/352 X |
| 4,457,144 | 7/1984 | Sawazaki | 66/132 T |

*Primary Examiner*—Stuart S. Levy
*Assistant Examiner*—Eric P. Dunlap
*Attorney, Agent, or Firm*—Spensley Horn Jubas & Lubitz

[57] ABSTRACT

Yarn 10 is fed from a package 11 to a point of knitting 12 on a knitting machine along a substantially closed path defined by tubing 13. Adjacent to a positive feeding device 14, the tubing 13 includes a section 15 which can be closed for initial blowing of the yarn through the tube, and opened to allow threading of the yarn 10 around the feeding device 14. This facilitates initial feeding of the yarn to the knitting machine, and also helps in the control of loose fly or lint generated from the yarn 10. The section 15 includes a tensioning device (30, not shown) for the yarn.

17 Claims, 2 Drawing Sheets

YARN FEED APPARATUS

BACKGROUND OF THE INVENTION

1. Field of the Invention

This invention relates to yarn feed apparatus, principally (though not exclusively) designed for use with yarns such as cotton which tend to shed lint.

2. Description of Related Art

It is well known that the production of lint during yarn processing can give rise to many problems, such as contamination of the working environment and the resultant fire hazard. A variety of techniques have been proposed for minimizing these problems, such as encasing the yarn creel in a ventilated unit incorporating filters, and passing the yarn through tubing from the take-off point at the cone or package to the input of a yarn feed device of a processing machine. However, due to difficulties in initially threading the yarn from the output of the feed device to the processing machine itself, to date the tubing has not been extended beyond the yarn feed device.

In addition, current yarn feed devices include many contact points against which the yarn rubs, thereby causing lint to be shed. For example, detectors must be provided to ensure that the processing machine is arrested in the event of abnormal tension on the yarn or the yarn breaking, and these detectors operate by contact with the yarn.

It is an object of the present invention to obviate or mitigate these particular problems.

SUMMARY OF THE INVENTION

In accordance with the present invention, this and other objectives are achieved by providing an apparatus for feeding yarn from a cone or a package or the like to a processing machine. The apparatus comprises a positive yarn feed device and tubing which defines a closed path for the yarn substantially over the entire distance from the cone or package to an end use point at the processing machine. The tubing includes a section adjacent to the yarn feed device which can be opened and closed. When this section is closed, it defines a path for threading the yarn past the yarn feed device. When this section is open, it provides access to the yarn to enable it to be engaged with the yarn feed device.

Preferably, said section is composed of a pair of tubes which are relatively moveable in an axial direction.

Conveniently, the yarn feed device comprises a rotatable drive element having axially spaced areas where the yarn is respectively driven and not driven when in contact with those areas, and at least one of the tubes is movable in a direction generally parallel to the rotation the axis of the rotatable element between axial positions wherein its end is aligned with the driving and non-driving areas of the rotatable element, respectively.

Desirably, said section is composed of a pair of fixed tubes whose ends are spaced apart to form a gap therebetween, and a further tube telescopically slidable in or on one of the fixed tubes to open and close said gap.

The apparatus may also include at least one detector to detect abonormal tension in the yarn and/or a break in the yarn. Preferably, two such detectors are provided respectively upstream and downstream of the yarn feed device. Advantageously, the or each detector is disposed within the tubing, and may operate on piezo electric principles. Preferably, the or each detector is located at a bend in the tubing.

Desirably, the apparatus further comprises a yarn tensioning device which includes a pair of members having confronting surfaces urged into engagement with one another, a nip formed between the confronting surfaces through which the yarn is passed to tension it, and recess means provided in at least one of the confronting surfaces to define a return path for the yarn wherein no substantial further tension is imparted to the yarn.

Preferably, the confronting surfaces are both of generally arcuate configuration, and the recess means is angularly displaced from the nip.

Conveniently, the members are both of tubular configuration and the yarn passes through an internal bore in one member prior to passing through the nip and through an internal bore in the other member after passing through the recess means.

Desirably, the members are disposed one above the other, and the upper member is urged against the lower member at least party by gravity. Alternatively or additionally, spring means (which may be adjustable) biases the members together.

Advantageously, the members are mounted within a tubular casing having a cut away portion, and the members are adjustable between at least two positions wherein both the nip and the recess means are respectively aligned and not aligned with the cut away portion. In this case, the member or members containing the recess means is/are preferably keyed against angular movement relative to the casing.

Conveniently, the members are moveable bodily to align said confronting surfaces selectively with said areas of the rotatable drive element of the yarn feed device.

The pair of members are preferably constituted by the tubes in said section.

Also according to the present invention, there is provided a yarn tensioning device comprising a pair of members having confronting surfaces urged into engagement with one another, a nip formed between the confronting surfaces through which the yarn is passed to tension it, and recess means provided in at least one of the confronting surfaces to define a return path for the yarn wherein no substantial further tension is imparted to the yarn.

BRIEF DESCRIPTION OF THE DRAWINGS

The invention will now be further described, by way of example only, with reference to the accompanying drawings in which.

DESCRIPTION OF THE PREFERRED EMBODIMENT

Figure 1:
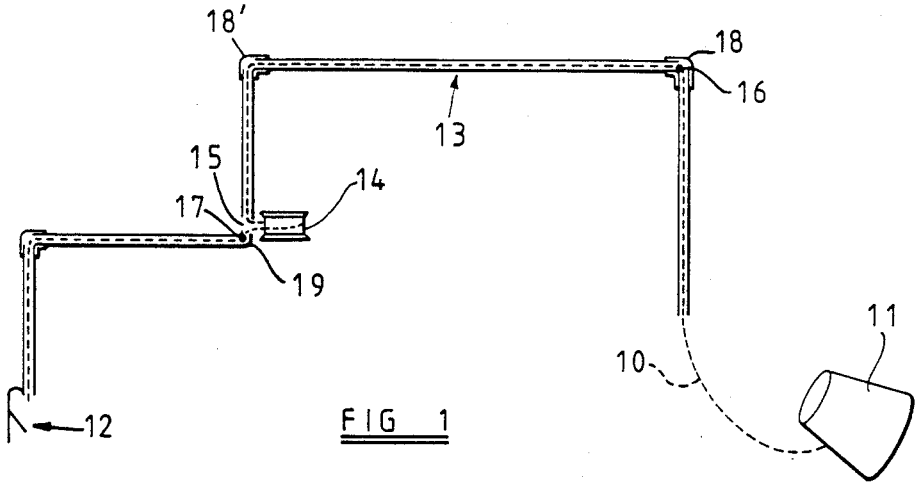
FIG. 1 is a schematic view of yarn feed apparatus according to the present invention.

Referring first to FIG. 1, yarn 10 from a cone or package 11 is fed to an end use point in a processing machine (e.g. a knitting machine shown schematically at 12) via tubing 13 which defines a closed path for substantially the whole of the distance between those locations. At a position adjacent to a yarn feeding device 14, the tubing 13 includes a section 15 which can be opened and closed and which will be described in detail later. Detectors 16 and 17 are provided respectively upstream and downstream of the yarn feed device 14, inter alia to detect abnormal tension or a break in the yarn 10, and are electrically connected to a stop motion circuit of the knitting machine or the yarn feed device. These detectors are disposed within the tubing 13 itself and operate on piezo-electric principles, being located at respective elbows 18 and 19 in the tubing where the yarn can readily be brought into contact with the detection surface of the detector.

Although the detector 16 is shown positioned at elbow 18 in the tubing, it could equally well be located at elbow 18' instead. However, it is preferred that the detector 17 is located substantially where indicated, i.e. a significant distance away from the point of knitting, to leave the maximum amount of time for the knitting machine to be stopped in the event of detector 17 sensing a break in the yarn.

Figure 2:
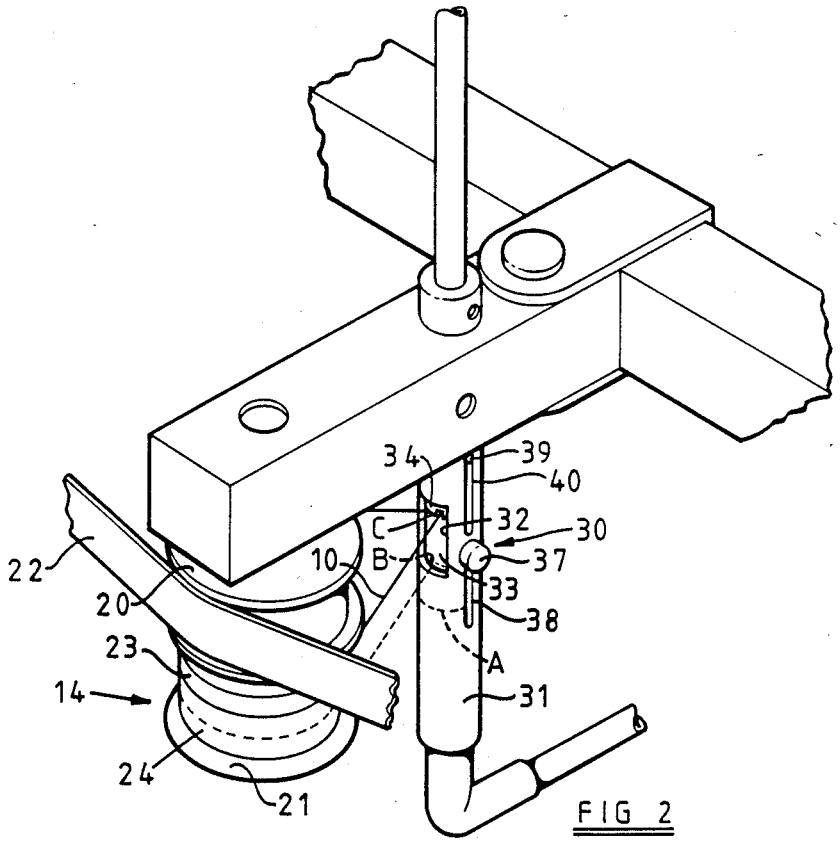
FIG. 2 is a perspective view of a yarn tensioning device which forms part of the yarn feed apparatus.

Referring now to FIG. 2, the yarn feeding device 14 is generally of conventional design and comprises a pair of axially spaced drums 20 and 21. The upper drum 20 is engaged by a drive belt 22 and is driven in synchronism with the yarn processing machine. The lower drum 21 rotates with the upper drum 20 and has two axially spaced surface areas 23 and 24. The area 23 is composed of relatively high frictional material and imparts a positive drive to the yarn 10 when engaged with the latter, while the area 24 is composed of relatively low frictional material which does not impart a positive drive to the yarn. The feeding device 14 may take other forms, if desired.

Figures 3, 4:
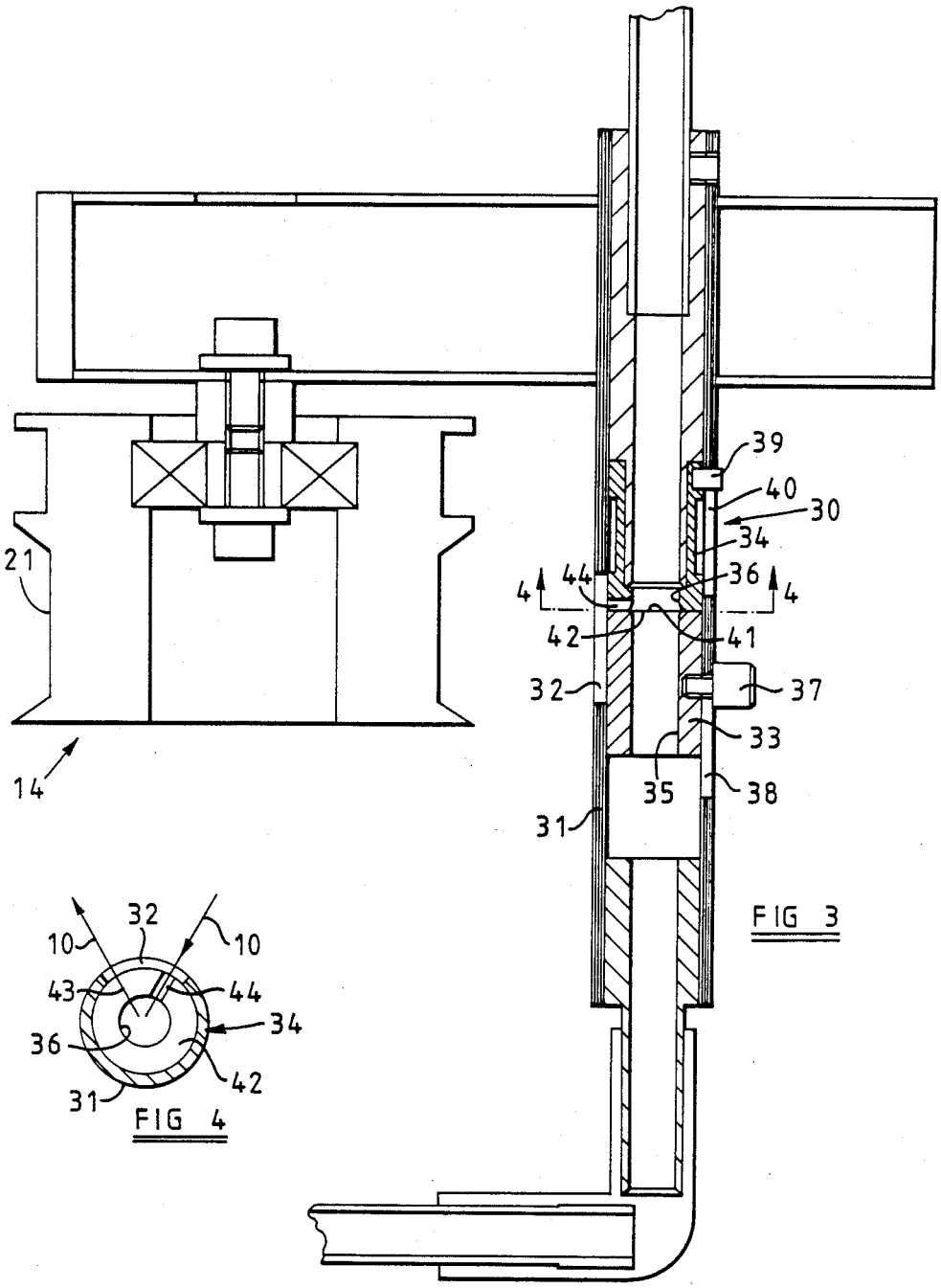
FIG. 3 is a sectional view of the yarn tensioning device shown in FIG. 2.
FIG. 4 is a section taken along the line 4—4 in FIG. 3.

Referring now also to FIGS. 3 and 4, the section 15 of the tubing includes a yarn tensioning device 30 composed of a vertically disposed tubular casing 31 having a cut away portion 32 which defines a window facing the feeding device 14. Housed within the casing 31 are two members 33 and 34 each of which is of tubular configuration with a respective internal bore 35,36. The lower member 33 is normally fixed, but its position axially of the casing 31 can be adjusted by means of a knob 37. This knob is threadedly engaged with the member 33 and projects from an axial slot 38 in the casing, so that the axial position of the member 33 can be fixed simply by screwing the knob 37 into engagement with the exterior of the casing 31. The upper member 34 is urged into contact with the lower member 33 by gravity, and is keyed against rotational movement relative to the casing 31 by a pin 39 which extends through an axial slot 40 in the casing 31.

Axial end surfaces 41 and 42 of the members 33 and 34 form a nip 43 through which the yarn 10 is passed to the feeding device 14. The end surface 42 of the upper member 34 is also provided with a radial recess 44 through which the yarn 10 is passed back from the feeding device 14. Because of the geometry of the arrangement, the nip 43 and the recess 44 are angularly spaced apart. Thus, in moving through the above-described apparatus, the yarn 10 passes up the internal bore 35 in the lower member 33, through the nip 43 (where it is tensioned), around the drum 21 of the feeding device 14, through the recess 44 (where substantially no further tension is imparted to the yarn), and up through the internal bore 36 in the upper member 34.

During operation of the apparatus, the lower member 33 (and hence the upper member 34 also) can be moved axially of the casing 31 between three nominal positions. In the first of these positions, the confronting surfaces 41 and 42 of the two members 33 and 34 are disposed below the level of a lower edge of the window 32 (as indicated in broken line at A in FIG. 2): the purpose of this will be explained later. In the second position, the confronting surfaces 41 and 42 are aligned with the area 24 on the drum 21 of the feeding device 14 (as indicated in broken line at B in FIG. 2). In the third position, the confronting surfaces are aligned with the area 23 on the drum (as depicted in solid line at C in FIG. 2). By moving the members 33 and 34 between positions B and C, the yarn 10 can be moved between non-drive and drive conditions on the drum 21.

The apparatus described above is particularly suited for use in a feed system where generation of lint from the yarn is a problem. The tubing from the yarn creel is attached to the bottom end of the casing 31, while the tubing to the knitting machine is attached to the top end of the casing 31. (Indeed, in principle the part of the apparatus illustrated in FIGS. 2 to 4 could be disposed within the yarn creel itself if this is of the enclosed type, in which case the first-mentioned tubing can be omitted). In this way, the yarn is encased for substantially the whole of its passage from the creel to the point of knitting, except where it passes around the feeding device 14. Therefore, lint generation can be controlled very closely, giving rise to reduced contamination of the surrounding atmosphere by free lint.

In such a system, it is convenient to feed the yarn through from the creel to the point of knitting by blowing. For this purpose, the members 33 and 34 are moved to position A to prevent the air used for the blowing operation from escaping between the confronting surfaces 41 and 42 to the surrounding atmosphere. Following on from this, the upper member 34 can be raised to separate the two surfaces 41 and 42, and thereby enable a loop of yarn to be taken out through the resultant gap and fed around the feeding device 14. After removal of the loop, the upper member 34 will simply fall under gravity to bring the two surfaces 41 and 42 together again, and the geometry of the arrangement will ensure that the ends of the loop are correctly positioned for locating in the nip 43 and the recess 44, respectively.

The arrangement of the tubing 13, particularly section 15, means that the yarn can initially be blow-threaded right through to the point of knitting, thereby greatly facilitating replacement of a broken yarn, for example.

In an alternative embodiment (not shown), the upper member 34 is spring biased into engagement with the lower member 33, and the degree of biasing can be adjusted to vary the tension imparted to the yarn 10 at the nip 43.

In a further alternative embodiment, the lower tubular member 33 is fixed within the casing 31, the upper tubular member 34 is capable of limited movement along the casing axis to open and close the gap between the surfaces 41 and 42, and the tensioning device 30 is moved bodily up and down to bring the surfaces 41 and 42 into alignment selectively with the areas 23 and 24 of the feed drum 21.

In a still further alternative embodiment (not shown) the tensioning device 30 is replaced by a simple arrangement comprising a pair of fixed tubes whose ends are spaced apart to form a gap therebetween, and a further tube which is telescopically slidable in or on one of the fixed tubes to open and close the gap. Initial blowing of the yarn through the tubing can take place when the further tube closes the gap, and the further tube can then be moved to open the gap to enable a loop of yarn to be removed and fed around the feeding device. In this case, a separate mechanism will of course be necessary for tensioning the yarn.

I claim:

1. Apparatus for feeding yarn from a cone or package or the like to an end use point at a processing machine, said apparatus comprising:

a positive yarn feed device, tubing defining a closed path for the yarn substantially over the whole distance from the cone or package to the end use point, the tubing including a section adjacent to said yarn feed device, the section being moveable between an open position and a closed position, said section in the closed position defining a path for threading the yarn past said yarn feed device, and said section in the open position providing access to the yarn, thereby enabling the yarn to be engaged with said yarn feed device when the section is in the open position.

2. Apparatus as claimed in claim 1, wherein said section is composed of a pair of fixed tubes, ends of said tubes are spaced apart to form a gap therebetween, and a further tube is telescopically slidable relative to said fixed tubes to open and close said gap.

3. Apparatus as claimed in claim 1, further comprising at least one detector to detect when there is abnormal tension in the yarn and when there is a break in the yarn.

4. Apparatus as claimed in claim 3, wherein two said detectors are provided respectively upstream and downstream of said yarn feed device.

5. Apparatus as claimed in claim 3, wherein said at least one detector is disposed within the tubing.

6. Apparatus as claimed in claim 5, wherein said at least one detector is located at a bend in said tubing.

7. Apparatus as claimed in any one of claims 3, wherein said at least one detector operates on piezo electric principles.

8. Apparatus as claimed in claim 1, further comprising a yarn tensioning device which includes a pair of members having confronting surfaces urged into engagement with one another, a nip formed between the confronting surfaces through which the yarn is passed to tension it, and recess means provided in at least one of the confronting surfaces to define a return path for the yarn wherein no substantial further tension is imparted to the yarn.

9. Apparatus as claimed in claim 8, wherein the confronting surfaces are both of generally arcuate configuration, and the recess means is angularly displaced from the nip.

10. Apparatus as claimed in claim 8, wherein said members are both of tubular configuration, and the yarn passes through an internal bore in one member prior to passing through the nip, and through an internal bore in the other member after passing through the recess means.

11. Apparatus as claimed in claim 8, wherein the said members are disposed one above the other, and the uppermost of said members is urged against the lowermost of said members at least partly by gravity.

12. Apparatus as claimed claim 8, wherein said members are mounted within a tubular casing having a cut-away portion, and said members are adjustable between at least two positions wherein both the nip and the recess means are respectively aligned and not aligned with the cut-away portion.

13. Apparatus as claimed in claim 12, wherein the member which contains the recess means is keyed against angular movement relative to the casing.

14. Apparatus as claimed in claim 8, wherein said yarn feed device comprises a drive element which is rotatable about an axis and which has first and second surface areas spaced along said axis, the yarn being driven when in contact with the first surface area and not being driven when in contact with the second surface area, and said members are moveable bodily to align said confronting surfaces respectively with said first and second surface areas.

15. Apparatus as claimed in claim 8, wherein said pair of members are constituted by the tubes in said section of said tubing.

16. Apparatus for feeding yarn from a cone or package or the like to an end use point at a processing machine, said apparatus comprising:

a positive yarn feed device, tubing defining a closed path for the yarn substantially over the whole distance from the cone or package to the end use point, the tubing including a section adjacent to said yarn feed device, the section being moveable between an open position and a closed position, said section in the closed position defining a path for threading the yarn past said yarn feed device, and said section in the open position providing access to the yarn, thereby enabling the yarn to be engaged with said yarn feed device when the section is in the open position, wherein said section is composed of a pair of tubes which are relatively moveable in an axial direction.

17. Apparatus as claimed in claim 2, wherein said yarn feed device comprises a drive element which is rotatable about an axis and which has first and second surface areas spaced along said axis, the yarn being driven when in contact with the first surface area and not being driven when in contact with the second surface area, and at least one of said tubes is moveable in a direction generally parallel to said axis between positions wherein an end of said tube is aligned with the first and second surface areas, respectively.

* * * * *